United States Patent [19]

Ahlgrim et al.

[11] 4,184,932

[45] Jan. 22, 1980

[54] ELECTROPOLISHING PROCESS

[75] Inventors: Michael Ahlgrim, Erftstadt; Gerhard Mietens; Helga Zygmann, both of Hürth-Efferen, all of Fed. Rep. of Germany

[73] Assignee: Hoechst Aktiengesellschaft, Frankfurt am Main, Fed. Rep. of Germany

[21] Appl. No.: 945,780

[22] Filed: Sep. 25, 1978

[30] Foreign Application Priority Data

Sep. 29, 1977 [DE] Fed. Rep. of Germany ..... 2743715

[51] Int. Cl.[2] ..... C25F 3/16; C25F 3/24

[52] U.S. Cl. ..... 204/129.43; 204/231

[58] Field of Search ..... 204/129.43, 231, DIG. 7, 204/129.25

[56] References Cited

U.S. PATENT DOCUMENTS

| | | | |
|---|---|---|---|
| 3,689,388 | 9/1972 | Diepers et al. | 204/129.43 |
| 3,850,769 | 11/1974 | Diepers et al. | 204/129.43 |
| 4,014,765 | 3/1977 | Roth et al. | 204/129.43 |
| 4,072,588 | 2/1978 | Diepers | 204/129.43 |

FOREIGN PATENT DOCUMENTS

| | | | |
|---|---|---|---|
| 2025392 | 12/1971 | Fed. Rep. of Germany | 204/129.43 |

*Primary Examiner*—T. M. Tufariello

*Attorney, Agent, or Firm*—Connolly and Hutz

[57] ABSTRACT

Axially unsymmetrical articles are electropolished zonewise, or the inside and outside surfaces of articles are electropolished zonewise and simultaneously. To this end a cathode of which the geometrical configuration and surface area correspond to the surface to be electropolished is arranged opposite an anode; more particularly, the cathode is subdivided into a plurality of segments which are non-conductive with respect to one another, through which segments a current of the necessary density is alternately passed and discontinued, at intervals, for a period compatible with the production of the desired electropolishing effect.

5 Claims, No Drawings

ELECTROPOLISHING PROCESS

This invention relates to a process for electropolishing an article having an electrically conductive surface, this surface being connected to a source of E.M.F. to form an anode.

Electropolishing the surfaces of metallic articles is a process which commonly comprises subjecting initially rough, uneven and dull articles to a treatment whereby they are given an even and shining metallic surface.

The electropolishing is conducted as an anodic treatment, the electrical connections being selected accordingly. This electropolishing treatment, wherein material is removed from a metal body connected to form an anode, is to be contrasted with electroplating, wherein one metal is electrodeposited on a body of another metal connected to form a cathode.

The electropolishing process permits structural components, regardless of their dimensions, to be polished in equipment which is relatively simple and widely applicable; this is equipment of a kind wherein the body to be electropolished is dipped in an electrolytic bath, the body being mounted on a support which is connected to form the anode. Titanium or copper is preferably used for providing the electrical connection to the anode, and also for the construction of the support, whereas stainless steel, lead or copper is commonly used as the cathode material.

As the electrolyte, the bath may contain (e.g.) a mixture of "thermal process" phosphoric acid and sulphuric acid, one or more alcohols or the like being included as desired. Electropolishing baths containing such electrolytes are very adaptable. They are easy to control and maintain, and relatively unsusceptible to disturbances. Depending on the electrolytes' particular composition and contemplated use, it is possible for them to be employed within wide ranges of current density and temperature, and also over various exposure periods.

It is indispensable however that the electropolishing should be effected with a certain optimal range of current density, inasmuch as a desirable polishing effect is obtainable only within certain limits of current density. In those cases in which the current density range selected for the polishing operation is insufficiently high, the metal surface becomes etched or dulled. Undesirably low current densities may occur if the current is obtained from a rectifier which has a capacity inadequate for electropolishing a large-surfaced object, or if the dispersing power of the electrolyte is rendered inadequate by the geometrical configuration of the article to be polished.

Protruding portions of an article, for example, are liable to shield those below them and to produce a current density gradient over the article which is to be electropolished so that its correct electropolishing is partially or completely prevented.

The magnitude of the current necessary for electropolishing depends on the area ($dm^2$) of the surface to be treated and also on the necessary current density (amperes/$dm^2$). The necessary current density in turn depends on the particular metal surface which is to be electropolished, and has to be predetermined in each particular case.

On the other hand, the current density obtainable depends on the capacity of the rectifier. In other words, the rectifier's capacity critically determines the maximum surface area which can be electropolished, and, since the geometrical configuration of the article may cause the current density to vary irregularly over its entire surface, it may prove impossible for it to be uniformly electropolished.

As disclosed in German Patent Specification No. 2,528,942, it is generally reasonably easy to electropolish round axially symmetrical articles. As taught in that specification, use is made of a small rotating cathode which is adapted to be gradually moved over the entire surface area to be electropolished. Needless to say, this method makes considerable demands in respect of equipment when, e.g., a square container is to be treated. In addition to this, a stationary basket-type cathode can be used only in those cases in which the capacity of the rectifier employed is sufficient to produce the current density necessary for electropolishing treatment.

Another problem often arises in connection with the electropolishing of the inside and outside surfaces of small containers. These are generally electropolished by an electrolytic bath process, in which use is made of an auxiliary cathode for supplying current to the containers' inside surfaces. This however is not fully satisfactory inasmuch as only the surface which is electropolished last is given the desired shining brightness if, e.g., the small container is treated so as to electropolish initially its outside surface and thereafter its inside surface. Those surface portions which are the last to be in the "shade" with respect to the electrolysis become redulled due to lower current density. It is also possible to electropolish simultaneously the inside and outside surfaces of a container, but in this event it is impossible to ascertain whether the current density was regularly distributed over the inside and outside surfaces.

Electrolytic baths are also frequently used for electropolishing large-surfaced but thin-walled articles which provide contact areas which are small in relation to the entire surface area of the article. These contact areas are therefore very frequently little more than points, which however have to have the dimensions necessary to ensure the delivery of the total current supplied to the surface. Failing this, the contact points would be liable to show traces of "burning", which is highly undesirable for, inter alia, visual reasons. To avoid this, it would be necessary for the current density to be drastically reduced, so that little or no polishing effect would be obtained.

It is an object of the present invention to provide a process which makes it possible to avoid the above difficulties, which have heretofore been encountered in the electropolishing especially of axially unsymmetrical articles, or during operations wherein the inside and outside surfaces of an article are electropolished simultaneously, or during the treatment of large-surfaced but thin-walled articles.

According to the present invention, therefore, we provide a process for electropolishing an article having an electrically conductive metallic surface, this surface being connected to a source of E.M.F. to form an anode, which comprises zonewise electropolishing an axially unsymmetrical article, or zonewise electropolishing simultaneously the inside and outside surfaces of an article, by arranging, opposite the anode, a cathode of which the geometrical configuration and surface area correspond to the surface to be electropolished, the cathode being subdivided into a plurality of segments which are non-conductive with respect to one another, through which segments a current of the necessary density is alternately passed and discontinued, at intervals, for a period compatible with the production of the desired electropolishing effect.

Preferably the cathode is subdivided into segments which are substantially equal in surface area. It is also preferable for the switch-on intervals and switch-off intervals during the electropolishing operation to be selected so as to provide, for a given segment, a ratio of switch-on period to switch-off period of 1:1 to 1:5. The intervals are preferably selected so as to produce interruptions of not less than 10 seconds and not more than 5 minutes for a given segment. For electropolishing the surface of a stainless steel article, it is good practice to establish a current density of 5 to 50 amperes per $dm^2$, preferably about 20 amperes per $dm^2$, at the anode and cathode. A particularly useful range for the current density just mentioned is $20\pm4$ amperes/$dm^2$.

In the event of the current being obtained from a rectifier, and the rectifier being of predetermined capacity, which may well be a normal case, cathode segments should desirably be employed whose surface area is compatible with the passage of a current of the above-mentioned necessary density whereby the desired electropolishing of the particular material concerned is effected.

The cathode, which is preferably subdivided into a plurality of independent areas, advantageously has its segments supplied with current via an interruption mechanism.

The time for which current is supplied to each cathode segment is limited, as already indicated. In other words, the individual segments are cyclically supplied with current.

The effect of the present technique of alternately passing and discontinuing the current may be compared to that which is produced with the aid of a mechanically moved cathode. The partial coverage of a surface with current permits high current densities to be obtained even with a rectifier of modest capacity or with a current-supplying system wherein the conductors have only a small cross-sectional area.

An unexpected result of the present process, which could not have been foreseen by one skilled in the art, is to be seen in the fact that it is possible to interrupt the electropolishing of a first surface portion at certain intervals, and, during the interruption periods, to electropolish an adjacent portion, provided however that the electropolishing of the said first portion is not interrupted for so long a period that during this period the first portion would be liable to become reroughened under the lower current density then prevailing.

The following Examples illustrate the invention, which is not, however, limited thereto.

EXAMPLE 1

A cubical stainless steel container having a capacity of 1 $m^3$ had its four vertical inside walls electropolished. A rectifier was used which had a capacity of 3000 amperes. The cathode, of which the configuration corresponded to the surface to be electropolished, had a surface area of 400 $dm^2$, permitting a maximum current density of 7.5 amperes per $dm^2$ to be obtained. Preliminary tests had shown this current density to be insufficient for producing a bright shining electropolishing effect by a plain electropolishing technique. Accordingly the cathode was subdivided into 4 segments having an area of 100 $dm^2$ each with separate electrical connections. By means of a switching mechanism, the current of 3000 amperes was applied to each segment in turn for 60 seconds. The interruption ratio thus was 1:3. The current density for each segment was 3000 amperes for 100 $dm^2$, i.e. 30 amperes per $dm^2$. This current density permitted a bright shining polishing effect to be produced on austenitic steels.

The total polishing period was 60 minutes.

EXAMPLE 2

A screw mixer of a complicated geometrical configuration, which had a total surface area of 3 $m^2$, was electropolished. To this end, it was necessary to use a cathode, similar in configuration, which was subdivided into 3 segments having an area of 1 $m^2$ each. A rectifier was used which had a capacity of 3000 amperes. The unsubdivided cathode permitted a current density of 10 amperes/$dm^2$ to be produced, in contrast with the cathode subdivided in accordance with this invention, which permitted a current density of 30 amperes/$dm^2$ to be produced. The interruption ratio was 1:2, and current was applied to each segment in turn for 1.5 minutes.

The total polishing period was 90 minutes.

EXAMPLE 3

A stainless steel tube which was 300 mm in internal diameter and 1 m long was electropolished both inside and outside. To this end, the tube was immersed in an electrolytic bath by means of an auxiliary suspending device; a cylindrical auxiliary cathode was used for electropolishing the tube's inside surface. The inside and outside surfaces were alternately electropolished at intervals of 3 minutes. A rectifier was used which had a capacity of 2000 amperes.

The total electropolishing period was 42 minutes. The inside and outside surfaces each had approximate areas of 1 $m^2$. A current of 20 amperes/$dm^2$ was produced by the interval switching.

EXAMPLE 4

(a) Punched (stamped) plates of stainless steel (known as material No. 14301), with the dimensions of $600\times50$ mm and 0.5 mm thick, were electropolished in an electrolytic bath. Placed centrally therein was an anode, and placed at each of the ends thereof was a cathode bar. It was desirable for the contact points to be concealed, for visual reasons. The articles were engaged by metal hooks so as to ensure point transfer of current. The total surface area was about 6 $dm^2$. A current density of about 20 amperes/$dm^2$ was necessary to produce a bright shining polish effect. In other words, 120 amperes were required to be passed to each plate via the contact points. However, this resulted in burning phenomena (weldings) at the contact points.

(b) The procedure of "(a)" was modified, in another trial, in that the cathode bars were separated electrically from each other, and current was applied separately thereto via a switching mechanism, in accordance with this invention.

The interruption ratio was 1:1. The current density was 20 amperes/$dm^2$ and a total of 60 amperes was applied per plate. The switching interval was 2 minutes and the total electropolishing period was 16 minutes.

We claim:

1. A process for electropolishing an article having an electrically conductive metallic surface, this surface being connected to a source of E.M.F. to form an anode, which comprises zonewise electropolishing an axially unsymmetrical article, by arranging, opposite the anode, a cathode of which the geometrical configuration and surface area correspond to the surface to be electropolished, the cathode being subdivided into a plurality of segments which are non-conductive with respect to one another, through which segments a current of the necessary density is alternately passed and discontinued, at intervals, so as to provide for a given segment a ratio of switch-on to switch-off period of 1:1 to 1:5 and the intervals are selected so as produce interruptions of at least 10 seconds and at most 5 minutes, with the production of the desired electropolishing effect.

2. A process for electropolishing an article having an electrically conductive metallic surface, this surface being connected to a source of E.M.F. to form an anode, which comprises zonewise electropolishing simultaneously the inside and outside surfaces of an article, by arranging, opposite the anode, a cathode of which the geometrical configuration and surface area correspond to the surface to be electropolished, the cathode being subdivided into a plurality of segments which are non-conductive with respect to one another, through which segments a current of the necessary density is alternately passed and discontinued, at intervals, so as to provide for a given segment a ratio of switch-on to switch-off period of 1:1 to 1:5 and the intervals are selected so as to produce interruptions of at least 10 seconds and at most 5 minutes, with the production of the desired electropolishing effect.

3. The process as claimed in any one of claims 1 or 2, wherein the cathode is subdivided into segments which are substantially equal in surface area.

4. The process as claimed in any one of claims 1 or 2, wherein the surface of a stainless steel article is electropolished with a current density of 5 to 50 amperes/$dm^2$ at the anode and cathode.

5. The process as claimed in any one of claims 1 or 2, wherein the current is obtained from a rectifier having a predetermined capacity and the cathode is divided in segments having such dimensions that from the given capacity of the rectifier and the surface of a segment the current density necessary for effecting the desired electropolishing results.

* * * * *